US005735216A

United States Patent [19]

Bullock et al.

[11] Patent Number: 5,735,216

[45] Date of Patent: Apr. 7, 1998

[54] ROLLER BEARING ADAPTER STABILIZER BAR

[75] Inventors: Robert L. Bullock, Antioch; Armand P. Taillon, Chicago, both of Ill.

[73] Assignee: Standard Car Truck Company, Park Ridge, Ill.

[21] Appl. No.: 682,842

[22] Filed: Jul. 12, 1996

Related U.S. Application Data

[63] Continuation-in-part of Ser. No. 365,414, Dec. 28, 1994, abandoned.

[51] Int. Cl.[6] ..... B61F 15/00

[52] U.S. Cl. ..... 105/218.1

[58] Field of Search ..... 105/167, 182.1, 105/218.1, 218.2, 219, 220, 222, 223, 224.05, 224.06, 224.1, 225

[56] References Cited

U.S. PATENT DOCUMENTS

| | | | |
|---|---|---|---|
| 1,182,705 | 5/1916 | Pilcher | 105/223 |
| 1,697,514 | 1/1929 | Priebe | 105/218.1 |
| 1,828,280 | 10/1931 | Buckius | 105/223 |
| 2,782,732 | 2/1957 | Rossell | 105/225 |
| 3,682,102 | 8/1972 | Pocklington et al. | 105/224.05 |
| 4,173,933 | 11/1979 | Kayserling | 105/224.05 |
| 4,742,779 | 5/1988 | Bevand | 105/218.1 |
| 5,090,333 | 2/1992 | Bieker et al. | 105/218.1 |
| 5,503,084 | 4/1996 | Goding et al. | 105/218.1 |

FOREIGN PATENT DOCUMENTS

| | | | |
|---|---|---|---|
| 959372 | 3/1957 | Germany | 105/218.1 |
| 2320323 | 12/1974 | Germany | 105/218.1 |
| 426255 | 9/1948 | Italy | 105/218.1 |
| 2-12263 | 8/1990 | Japan | 105/218.1 |

*Primary Examiner*—Mark T. Le

*Attorney, Agent, or Firm*—Dorn, McEachran, Jambor & Keating

[57] ABSTRACT

A three piece rail car truck has a pair of side frames, a pair of wheelsets and a roller bearing adapter seated on each end of each wheelset. Each side frame has pedestal jaws formed and adapted to seat upon each roller bearing adapter. The improvement comprises a stabilizer bar connected between each roller bearing adapter and an adjacent portion of a side frame, with the stabilizer bars resisting unsquaring relative movement between the wheelsets and side frames.

6 Claims, 3 Drawing Sheets

Fig. 1.
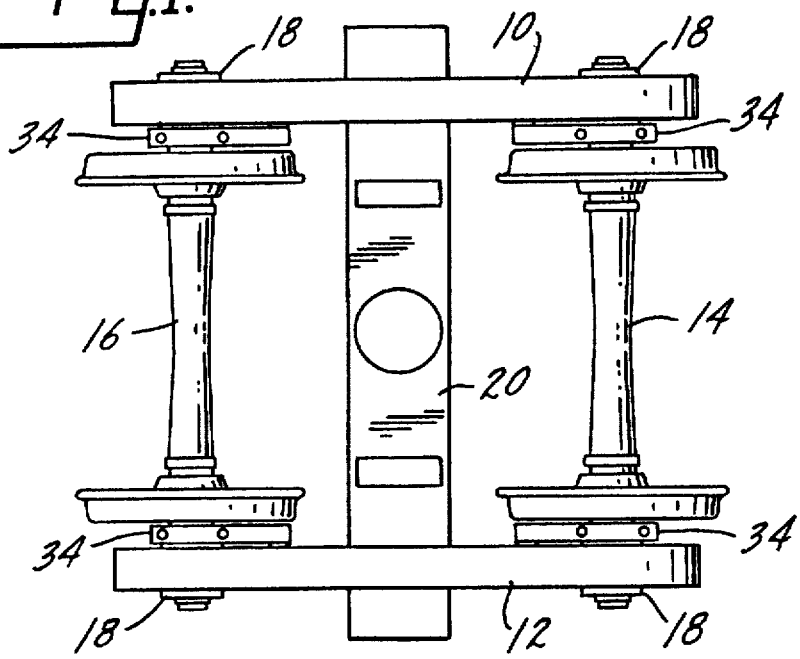
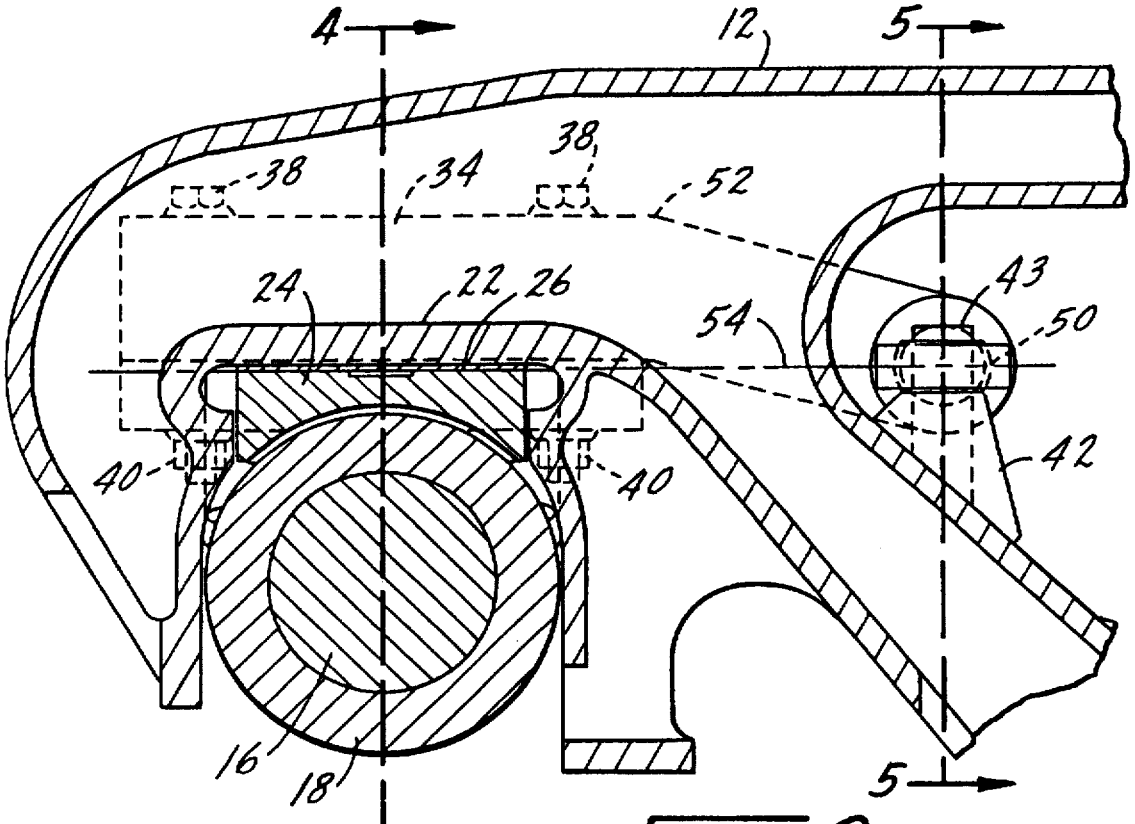
Fig. 2.

ROLLER BEARING ADAPTER STABILIZER BAR

This is a continuation-in-part of application Ser. No. 08/365,414, filed on Dec. 28, 1994, now abandoned.

THE FIELD OF THE INVENTION

The present invention relates to three-piece railroad car trucks, and more particularly to a stabilizer bar which rigidly attaches to the roller bearing adapter and side frame, and resists relative yaw movement between the side frames and wheelsets. By rigidly mounting the stabilizer bar as a cantilevered stiff beam to each of four specially designed roller bearing adapters and connecting the cantilevered end articulately to an adjacent location on each side frame, it is possible to resist relative yaw movement between the wheelsets and the side frames. By increasing the resistance to relative yaw movement between the wheelsets and the side frames, an increased interaxle shear stiffness, or truck warp stiffness, can be achieved. Warp stiffness, a characteristic in which three-piece trucks are known to be deficient, is critical in determining high speed stability and curving performance. It is the objective of the present invention to increase the warp stiffness of the three-piece truck in order to achieve improved high speed stability and curving performance. The resistance the stabilizer bars provide to the relative yaw movements between the side frames and wheelsets increases the truck warp stiffness, because truck warp is the relative yaw movement between the side frames and the wheelsets.

BACKGROUND OF THE INVENTION

In North American freight railroad service, conventional three-piece freight car trucks having two wheelsets have evolved to satisfy a variety of important operating and economic requirements. Among other requirements, they must be capable of safely supporting and equalizing very high wheel loads over a wide range of track conditions while delivering a high level of economic value to the railroads that use them. In addition to those basic criteria, the trucks and their parts must be interchangeable throughout the system of interconnected railroad networks. The three-piece trucks in service today have, to a large extent, met these requirements because their general designs are simple, flexible, durable and reliable. However, in this evolutionary process a major aspect of truck design for performance efficiency has been largely ignored, design for warp stiffness.

When a conventional three-piece truck encounters sufficient energy in the course of its normal use, usually due to high speed operation, the wheelsets are forced to move laterally relative to the track and relative to one another, causing the instability known as truck hunting. Truck hunting is undesirable, because it causes high lateral forces to be imparted to the rail vehicle and its lading, and because it produces increased drag on the locomotive, resulting in reduced efficiency. Likewise, when a conventional three-piece truck encounters a curve in the normal course of its use, the wheelsets are often forced to move laterally relative to one another, resulting in a condition known as truck warp. Truck warp is undesirable because it causes a high angle of attack to arise between the leading wheelset and the rail, resulting in high rates of wear on the rails and wheels. Whether they are a result of high speed or curving, truck hunting and truck warp are generally characterized by a lateral displacement of the wheelsets relative to one another and a change of the square relationship of the axles relative to the side frames into an angular relationship.

The recent testing of conventional three-piece freight car truck designs has shown that a large proportion of the interaxle shear stiffness which governs their performance is attributable to the side frame pedestal to roller bearing adapter connection. However, the current standard design of this connection has an inherent problem in that it only provides resistance to unsquaring movements between the side frames and wheelsets by means of coulomb friction. Theoretical modeling and real track testing have proven that, in terms of warp stiffness, friction alone is not sufficient to produce optimum efficiency in curving and stability performance. Rather, optimum performance requires that a constant linear spring stiffness exist, in addition to the friction characteristic, between the wheelsets to resist their relative lateral movement.

The side frame to roller bearing adapter connection design is generally characterized by a roller bearing adapter in a loosely fit upside down U-shaped pedestal jaw which allows the relative freedom of the side frame to rotate in yaw and roll with respect to the roller bearing adapter. The connection is comprised of a flat bearing surface on the side frame end, the pedestal, which bears on an arcuate upper bearing surface on the roller bearing adapter, the crown. The connection is completed by a pair of pedestal jaws, one fore and one aft of the roller bearing adapter, each having on its surface a thrust lug for bearing the longitudinal and lateral forces of the roller bearing adapter relative to the side frame. This connection is specified by AAR standards to have a minimum gap between the vertical surfaces of 1/16. Therefore, it forms a loose connection that allows the side frame to rotate in the horizontal plane and roll in the vertical plane relative to the roller bearing adapter. In part, the pedestal connection is designed this way in order to ensure a uniform load distribution on the roller bearing for maximum durability and reliability. However, it is this gap fit connection and the lack of a yaw spring stiffness between the side frame and axle that is the fundamental problem with the interaxle shear stiffness of the three-piece truck.

Another important aspect of the three-piece truck frame is the connection between the roller bearing adapter and the roller bearing. This connection is generally characterized by a very close, uniform fit. Specified in AAR standards, this connection ensures that loads on the roller bearing are evenly distributed and that the roller bearing does not move relative to the roller bearing adapter. As a result, the roller bearing adapter moves rigidly with the roller bearing which moves with the axle.

Prior art structures describing connections between the truck frame and the journal box, journal box adapter or roller bearing adapter exist in different forms and they vary in their configurations and their intended purposes. One prior art structure in particular, Rossell U.S. Pat. No. 2,782,732, describes a device which has as its objective to fix a plate in a pedestal jaw by means of two parallel longitudinal links and one lateral link as a frictional interface interposed between the journal box and suspension element. The described purpose of the prior art structure was to "impose a heavy frictional resistance to the journal boxes in order to increase high speed stability by breaking up the harmonic axle motions which cause hunting." While the Rossell invention may have been effective at improving high speed stability in a box frame truck, it would not be effective at increasing warp stiffness in a three-piece truck.

The usefulness of the prior art structure in Rossell is limited in that it would only be effective and useful on a box frame truck with a primary suspension. As opposed to a three-piece truck, a box frame truck has an integrally cast rectangular unit frame that encompasses and rests on a suspension above the wheelsets' journals. Unlike the three-piece truck, the box frame truck has an inherent warp stiffness, because the basic frame is one large cast piece. When attached to a box frame, the Rossell three link structure would effectively restrain the described friction plate against lateral and longitudinal movement. In a three-piece truck, however, the three link structure would have no effect on warp stiffness because the link structure is designed to resist translation and would not effectively resist the relative yaw movements that occur between the side frame and roller bearing adapter. This is because Rossell describes a link that is connected from the truck frame to the roller bearing adapter with single point, flexible, jointed ends which can only resist forces in tension and compression and not in rotation.

Another aspect of the prior art in Rossell is that it describes a structure that connects the truck frame with a friction plate that is interposed between the journal box and the suspension element. In the modern three-piece truck, however, the roller bearing adapter and the roller bearing have such a close fit that they are the functional equivalent of the journal boxes of the old technology. Therefore, the friction plate described in Rossell is not the functional equivalent of the roller bearing adapter. Rather, it is the functional equivalent of a wear plate interposed, in the three-piece truck, between the roller bearing adapter crown and the side frame pedestal. Such a structure, in the three-piece truck, would have no effect whatsoever.

SUMMARY OF THE INVENTION

The present invention relates to three-piece freight car trucks, and in particular to a three-piece freight car truck which increases warp stiffness.

Another purpose of the invention is a freight car truck design having increased interaxle shear stiffness while permitting limited rolling movement between the side frame and wheelsets.

Another purpose of the invention is a side frame/wheelset support system for a rail car truck which utilizes a stabilizer bar connected between each roller bearing adapter and an adjacent portion of each side frame to resist relative yaw movement between the side frames and the wheelsets.

Another purpose of the invention is a side frame/wheelset support system, as described, in which the stabilizer bar is rigidly mounted to the roller bearing adapter, with an end extending away from the roller bearing adapter, parallel to the longitudinal axis of the side frame, in the form of a cantilevered beam.

Another purpose of the invention is a side frame/wheelset support system, as described, in which the stabilizer bar has an articulated connection with the side frame to permit limited side frame rolling movement relative to its supporting wheelset about an axis drawn longitudinally, along the side frame, between the center points of the side frame's two journal boxes.

Another purpose of the invention is a side frame/wheelset support system as described, in which the stabilizer bar has an articulated connection with the side frame to resist longitudinal and lateral translation movements between the cantilevered end of the stabilizer bar and the side frame.

Another purpose of the invention is a side frame/wheelset support system as described, in which the roller bearing adapter coacts with the roller bearing on the wheelset as-an integral part of the wheelset such that the roller bearing adapter moves in unison with the wheelset.

Another purpose of the invention is a side frame/wheelset support system as described, in which the stabilizer bar coacts with the roller bearing adapter and the side frame and provides resistance to relative yaw movement between the side frame and the wheelset. The relative yaw movement which occurs between the side frame and the wheelset causes an angular shift to occur between the side frame and the wheelset from a square to an obtuse or an acute angle. The angular shift which occurs between the side frame and the wheelset causes a deflection to occur in the stabilizer bar. The deflection which occurs in the stabilizer bar creates a counter rotational force on the roller bearing adapter relative to the side frame which is zero only when the side frame is in the square angular position relative to the roller bearing adapter. The counterrotational force which is created on the roller bearing adapter is transferred directly to the wheelset which is continuously square relative to the roller bearing adapter. The resistance to relative yaw rotation which is created between the side frames and the wheelsets causes an increase in the three-piece truck frame warp stiffness, because warp stiffness is a function of the relative yaw stiffness between the side frames and the wheelsets.

Other purposes will appear in the ensuing specification, drawings and claims.

BRIEF DESCRIPTION OF THE DRAWINGS

The invention is illustrated diagrammatically in the following drawings wherein:

FIG. 1 is a top plan view of the rail car truck of the present invention;

FIG. 2 is an enlarged vertical section illustrating the side frame roller bearing adapter connection;

DESCRIPTION OF THE PREFERRED EMBODIMENT

Figure 3:
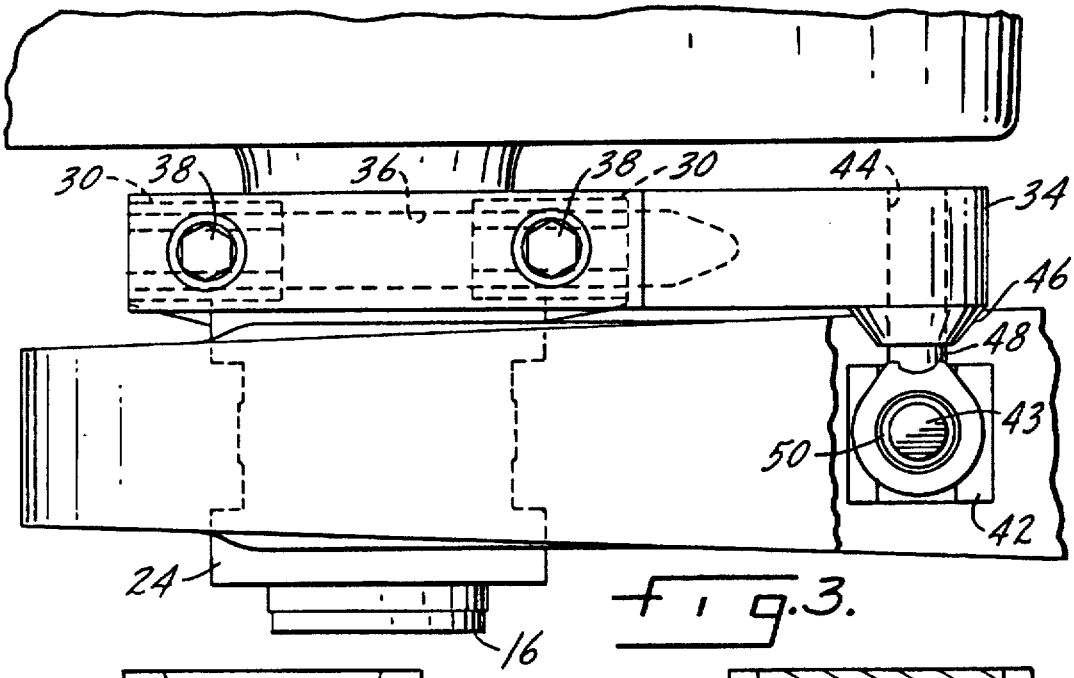
FIG. 3 is a bottom view, in part section, illustrating the side frame roller bearing adapter connection.
Figure 4:
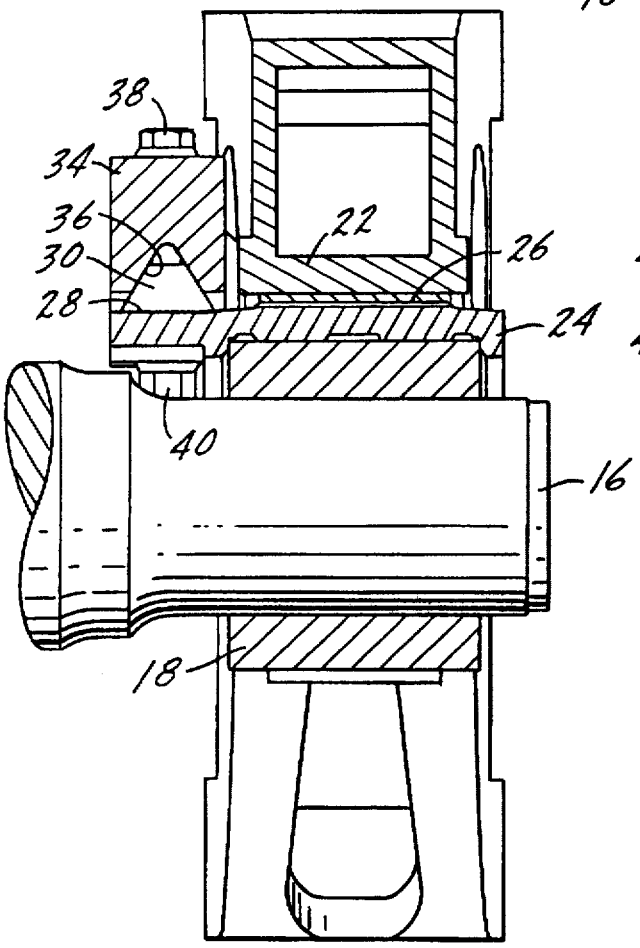
FIG. 4 is a section along plane 4—4 of FIG. 2.
Figure 5:
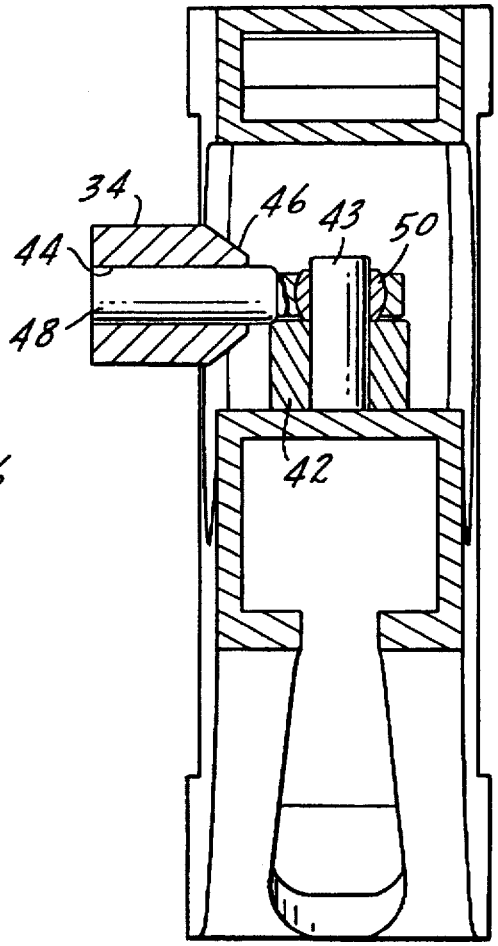
FIG. 5 is a section along plane 5—5 of FIG. 2.
Figure 6:
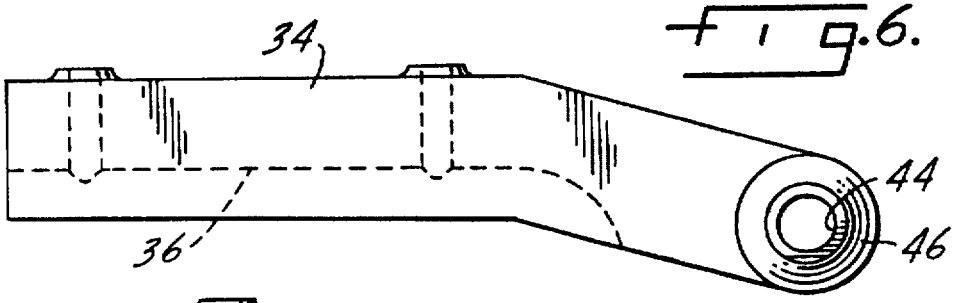
FIG. 6 is a side view of the stabilizer arm.
Figure 7:
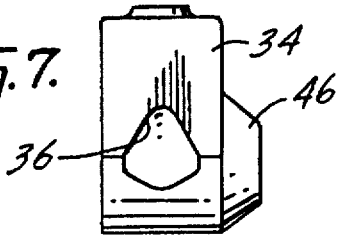
FIG. 7 is an end view of the stabilizer arm.
Figure 10:
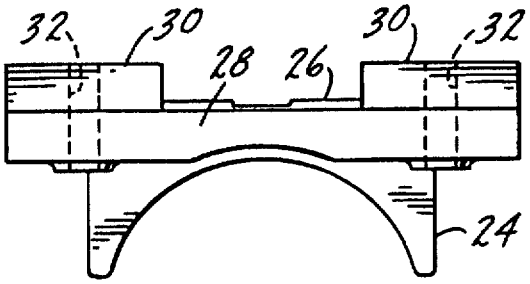
FIG. 10 is a side view, from the opposite side, of the roller bearing adapter.
Figure 8:
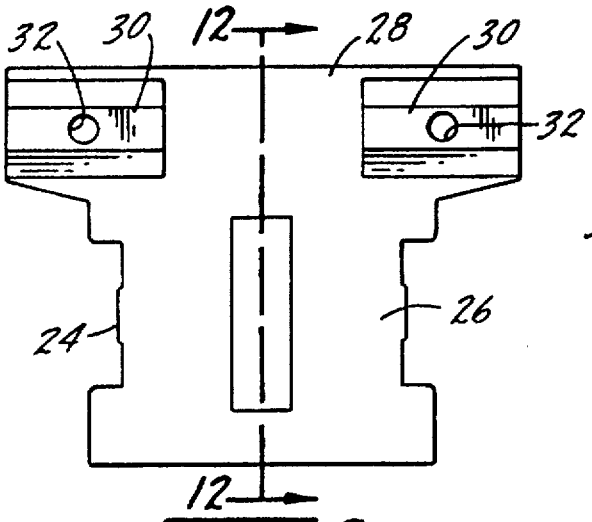
FIG. 8 is a top view of the roller bearing adapter.
Figure 11:
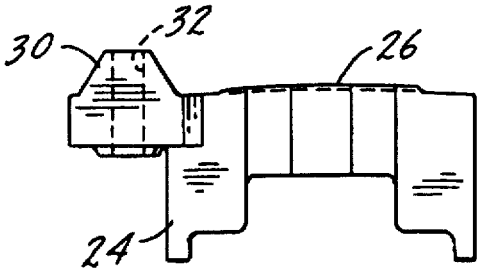
FIG. 11 is a front view of the roller bearing adapter.
Figure 9:
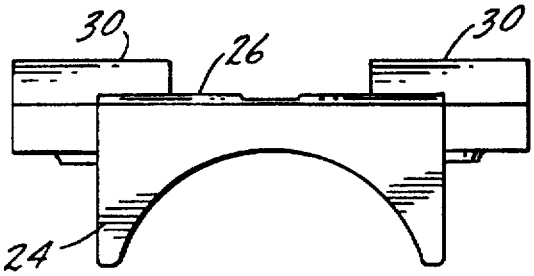
FIG. 9 is a side view of the roller bearing adapter.
Figure 12:
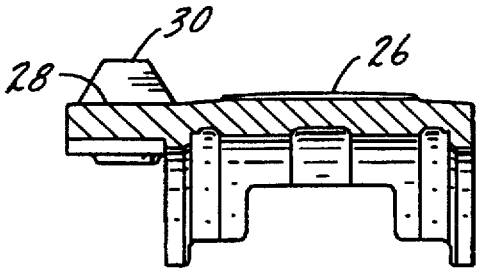
FIG. 12 is a section along plane 12—12 of FIG. 8.

The present invention relates to freight car trucks and specifically to an improved interconnection between the side frame and the supporting wheelsets which will improve truck performance in high speed operation and curving. The truck design disclosed herein will increase warp stiffness or interaxle shear stiffness or the resistance to the unsquaring forces which are applied to the truck during operation. A stabilizer bar is rigidly connected to the inboard side of each roller bearing adapter and extends parallel to the longitudinal axis of the side frame to an adjacent portion of the side frame. The connection between the stabilizer bar and the side frame is articulated, providing resistance to relative lateral and longitudinal translational movement and permitting limited rolling movement of the side frame relative to the wheelsets about an axis drawn between the side frame's journal box centers.

In a conventional three-piece freight car truck, the interaxle shear stiffness which controls stability and curving performance is contributed mostly by the side frame pedestal to roller bearing adapter connection. The problem with the current design of this connection is that it only provides interaxle shear stiffness by means of coulomb friction. The connection does not provide the linear yaw spring stiffness necessary to provide adequate warp stiffness.

In particular, the frictional resistance characteristic is comprised of two modes of action, static and kinetic friction. The static mode is characterized by a resistance against applied forces sufficient to resist relative movement between the roller bearing adapter and the side frame and it is substantially higher in resistance force than the kinetic mode. The kinetic mode is characterized by the resistance imposed while the side frame is rotating, in a sliding fashion in yaw relative to the roller bearing adapter. At low speeds and under moderate curving conditions, the static mode of frictional resistance effectively resists relative yaw movement between the side frame and roller bearing adapter. However, at higher speeds and under severe curving conditions, the input forces overpower the static mode of frictional resistance and cause the side frames to slide in kinetic yaw movement relative to the roller bearing adapters.

By applying a yaw spring stiffness to the connection between the side frames and roller bearing adapters, it is possible to dramatically increase the warp stiffness of the conventional freight car truck. The present invention provides a stiff beam, the stabilizer bar, connected between the side frame and the roller bearing adapter as a yaw spring which increases warp stiffness. The stabilizer bar is joined on one end to the roller bearing adapter by a rigid connection and on the other end by an articulated connection to an adjacent location on the side frame. The rigid connection between the stabilizer bar and the roller bearing adapter provides a cantilevered beam stiffness to the stabilizer bar. The articulated connection of the stabilizer bar to the side frame provides resistance to translational movement of the cantilevered end of the stabilizer bar relative to the side frame. It also permits a limited degree of rolling movement between the side frame and the roller bearing adapter necessary to ensure optimum roller bearing life and performance.

In FIG. 1, a typical freight car truck includes a pair of side frames 10 and 12, each of which is seated upon wheelsets 14 and 16. Each of the wheelsets has roller bearings indicated at 18 and the side frames are seated upon the roller bearings in a manner to be described. The typical three-piece freight car truck is completed by a bolster 20 which normally will be spring supported in windows of the side frames 10 and 12.

Looking specifically at FIGS. 2 and 3, which illustrate one side frame to wheelset interconnection, the side frame has a pedestal indicated at 22 which is seated upon a roller bearing adapter 24. As is conventional, the upper surface 26 of the roller bearing adapter is formed in the shape of a small crown with a radius of approximately 60". This is a standard AAR mandated roller bearing adapter surface which will be centered on the adapter and provides a degree of roll freedom for the side frame to roll relative to the roller bearing adapter.

The roller bearing adapter has, at its inboard side, an outwardly extending shoulder or projection 28 which in turn supports two spaced truncated upwardly extending projections 30, each of which has a bore 32. A stabilizer bar 34 has a downwardly facing truncated recess 36 which mates with the projections 30 to form a solid and rigid connection between the stabilizer bar and the roller bearing adapter. Headed bolts 38 and cooperating nuts 40 are used to bolt the stabilizer bar to the inboard side of the roller bearing adapter.

A post block 42 is attached, for example by welding, to each side frame in the area adjacent to the pedestal 22 and in a position to be connected to the stabilizer bar 34. Each post block 42 includes an upwardly extending post 43. Each stabilizer bar has a bore 44 and a frustoconic projection 46 which is concentric with the bore. Mounted within each bore 44 is a rod end bearing which extends outwardly from the bore 44 and has a bearing 50 which coacts with the stabilizer bar and the side frame, permitting the side frame to have the desired and necessary limited degree of rolling movement relative to the roller bearing adapter and thus the wheelset.

The stabilizer bar has an intermediate bend 52 which places the axis of the bore 44 and thus the axis of the bearing 50 coincident with the side frame roll center axis, as indicated by the broken line 54. Thus, the articulated connection which permits movement between the side frame and the stabilizer bar is coincident with the roll axis of the side frame relative to the roller bearing adapter. This is necessary so that there can be the described rolling movement between the side frame and the wheelsets.

Of primary importance in the invention is the provision of a stiffening connection between the side frame and the roller bearing adapter, resisting relative yaw movement between these elements and thus restraining the unsquaring forces applied to the truck between the wheelsets and the side frames. The stabilizer bar provides interaxle shear stiffness in the conventional three-piece truck by creating a resistance to yaw movement between the roller bearing adapter and the side frame. It does this in such a manner as to permit rolling movement between the side frame and the wheelset, which movement does not in any way limit the yaw restraint provided by the stabilizer bar.

The invention as described is suitable for both new truck construction and as a retrofit for existing trucks. In the retrofit situation the existing roller bearing adapter will be replaced by the described roller bearing adapter having the support shoulder for the stabilizer bar. The post block is welded in the desired location on the side frame and then the stabilizer bar can be connected between the side frame and the roller bearing adapter.

Whereas the preferred form of the invention has been shown and described herein, it should be realized that there may be many modifications, substitutions and alterations thereto.

The embodiments of the invention in which an exclusive property or privilege is claimed are defined as follows:

1. A three-piece rail car truck having a pair of side frames, a bolster extending between said side frames, a pair of wheelsets, roller bearing adapters, each of which is seated on an end of said wheelsets, each of said side frames having a pedestal at each end thereof formed and adapted to seat upon one of the roller bearing adapters, the improvement comprising a stabilizer bar connected between each of said roller bearing adapters and an adjacent portion of one of said side frames, the connection between each of said stabilizer bars and one of the roller bearing adapters being rigid, the connection between each of said stabilizer bars and one of the side frames providing for limited movement therebetween, each of said stabilizer bars being significantly less stiff than an axle or the side frames and functioning as a yaw spring stiffness between said axle and side frame, thereby resisting unsquaring relative movement between the wheelsets and side frames.

2. The rail car truck of claim 1 wherein the connection between each of said stabilizer bars and its adjacent side frame is articulated and permits relative rolling motion between each of said roller bearing adapters and the side frame.

3. The rail car truck of claim 2 wherein each articulated connection includes a rod end bearing fixed to one of said stabilizer bars and a post block fixed to an adjacent portion of the side frame, with the post block extending into the rod end bearing.

4. The rail car truck of claim 3 wherein an axis of each of said rod end bearings is coincident with an axis of side frame rolling motion relative to the roller bearing adapter.

5. The rail car truck of claim 4 wherein each of said post blocks is welded to one of said side frames.

6. The rail car truck of claim 2 wherein each of said roller bearing adapters has an outwardly directed projection, with each of said stabilizer bars being fixed to said projection on an inboard side of said roller bearing adapter.

* * * * *